US008052487B2

(12) United States Patent
Zhu

(10) Patent No.: US 8,052,487 B2
(45) Date of Patent: Nov. 8, 2011

(54) ELECTRICAL CONNECTOR WITH POSITIONING SPACER ENGAGING WITH TERMINALS THEREON

(75) Inventor: Yu Zhu, Shenzhen (CN)

(73) Assignee: Hon Hai Precision Ind. Co. Ltd., New Taipei (TW)

( * ) Notice: Subject to any disclaimer, the term of this patent is extended or adjusted under 35 U.S.C. 154(b) by 0 days.

(21) Appl. No.: 12/785,510

(22) Filed: May 24, 2010

(65) Prior Publication Data

US 2011/0028045 A1 Feb. 3, 2011

(30) Foreign Application Priority Data

Jul. 28, 2009 (CN) ..... 2009 2 0306951

(51) Int. Cl.
*H01R 13/502* (2006.01)

(52) U.S. Cl. ..... 439/695

(58) Field of Classification Search ..... 439/660, 439/78–84, 374, 381, 733, 751, 695, 701, 439/686

See application file for complete search history.

(56) References Cited

U.S. PATENT DOCUMENTS

| | | | | |
|---|---|---|---|---|
| 3,409,862 | A * | 11/1968 | Lynch et al. | 439/695 |
| 4,550,962 | A * | 11/1985 | Czeschka | 439/78 |
| 5,252,080 | A * | 10/1993 | Pesson | 439/79 |
| 5,453,016 | A * | 9/1995 | Clark et al. | 439/79 |
| 5,785,537 | A * | 7/1998 | Donahue et al. | 439/79 |
| 6,331,122 | B1 | 12/2001 | Wu | |
| D469,407 | S | 1/2003 | Wu | |
| 7,234,951 | B2 * | 6/2007 | Wang | 439/79 |
| 7,497,709 | B1 | 3/2009 | Zhang | |
| 7,722,366 | B2 * | 5/2010 | Yamamoto et al. | 439/79 |

* cited by examiner

*Primary Examiner* — Edwin A. Leon

(74) *Attorney, Agent, or Firm* — Wei Te Chung; Andrew C. Cheng; Ming Chieh Chang

(57) ABSTRACT

An electrical connector defines an insulative housing defining a mating portion having a plurality of passageways therein, a plurality of terminals separated into two distinct groups and received in the housing, and a spacer assembled to back side of the housing for fixing the leg portions of the terminals. The terminal defines a contacting portion received in the passageways, a body portion extending rearward from an end of the contacting portion and a leg portion extending downward from an end of the body portion, the body portion and the leg portion are exposed outside of the housing. The spacer has an inner face defining a pressing platform having a bottom face at least pressing the body portion of the one group of terminals.

19 Claims, 8 Drawing Sheets

ELECTRICAL CONNECTOR WITH POSITIONING SPACER ENGAGING WITH TERMINALS THEREON

BACKGROUND OF THE INVENTION

1. Field of the Invention

The present invention relates to an electrical connector, and more particularly to an electrical connector having a spacer engaging with terminals which assembled to a housing of the electrical connector.

2. Description of Related Arts

Parallel ATA (Advanced Technology Attachment) and parallel SCSI are two dominant hard disk (HD) interfaces technologies today. The parallel ATA disks are widely used in desktop PCs and portable PCs, and the parallel SCSI disks are mainly used in high-volume servers and subsystems. As disk interconnect speeds continue to rise, existing parallel ATA and parallel SCSI buses are reaching their performance limits because that parallel transmissions are susceptible to crosstalk across multiple streams of wide ribbon cable that adds line noise and can cause signal errors—a pitfall that has been remedied by slowing the signal, limiting cable length or both. Therefore, new interconnect technologies are needed to meet performance requirements going forward. The serial technology is emerging as a solution to the problem. The main advantage of serial technology is that while it does move data in a single point-to-point stream, it does so much faster than parallel technology because it is not tired to a particular clock speed.

Serial ATA (SATA) is a serial version of ATA, which is expected to be a replacement for parallel ATA. U.S. Pat. No. 6,331,122 discloses a type of SATA receptacle connector for being mounted on a printed circuit board. The receptacle connector has two receiving cavities defined in an insulative housing thereof and two sets of conductive terminals respectively used for power and signal transmission installed in the insulative housing. Another U.S. Pat. No. D469,407 discloses an electrical connector assembly with a SATA plug connector as a part thereof. The plug connector has two generally L-shaped tongue plates receiving two sets of terminals for electrically connecting the conductive terminals as the tongue plates are inserted into the respective receiving cavities of the receptacle connector.

Serial Attached SCSI (SAS) is a successor to the parallel SCSI and is also based on serial technology. Besides the advantage of higher speed signal transmission, another most significant advantage is the SAS interface will also be compatible with SATA drives. In other words, the SATA plug connector can plug directly into an SAS receptacle connector if supported in the system. By this way, the system builders are flexible to integrate either SAS or SATA devices and slash the costs associated with supporting two separate interfaces.

U.S. Pat. No. 7,497,709 issued to George discloses a kind of SAS receptacle connector which has generally the same configuration as the SATA receptacle connector. The SAS receptacle connector has two sets of terminals conformable with SATA signal provision in the receptacle connector. A third set of signal terminals is further arranged to a second side wall opposing to a first side wall where said two sets of terminals are arranged. Each terminal defines a planar portion having a mating portion exposed in the cavity and a vertical leg portion extending downwardly from the planar portion. For protecting the terminal, the receptacle connector further defines a spacer for fixing the lower end of the vertical leg portion of the terminal. However, the spacer limits the terminals in the transverse direction only but not in the vertical direction, therefore the planar portion of terminal may be broken when the connector is mounted to a print circuit board.

Hence, a new electrical connector is desired.

SUMMARY OF THE INVENTION

A major object of the present invention of to provide an electrical connector, which provide a positioning spacer to protect terminals in multi-direction.

To fulfill the above-mentioned object, an electrical connector defines an insulative housing defining a mating portion having a plurality of passageways therein, a plurality of terminals separated into two distinct groups and received in the housing, and a spacer assembled to back side of the housing for fixing the leg portions of the terminals. The terminal defines a contacting portion received in the passageways, a body portion extending rearward from an end of the contacting portion and a leg portion extending downward from an end of the body portion, the body portion and the leg portion are exposed outside of the housing. The spacer has an inner face defining a pressing platform engaging with the body portion of the one group of the terminals. With this design, the spacer defines the pressing platform engaging with the body portion of the one group of the terminals for protecting the body portion of the one group of the terminals at the vertical direction when the connector mounted to a print circuit board.

Other advantages and novel features of the invention will become more apparent from the following detailed description of the present embodiment when taken in conjunction with the accompanying drawings

DETAILED DESCRIPTION OF THE PREFERRED EMBODIMENT

Figure 1:
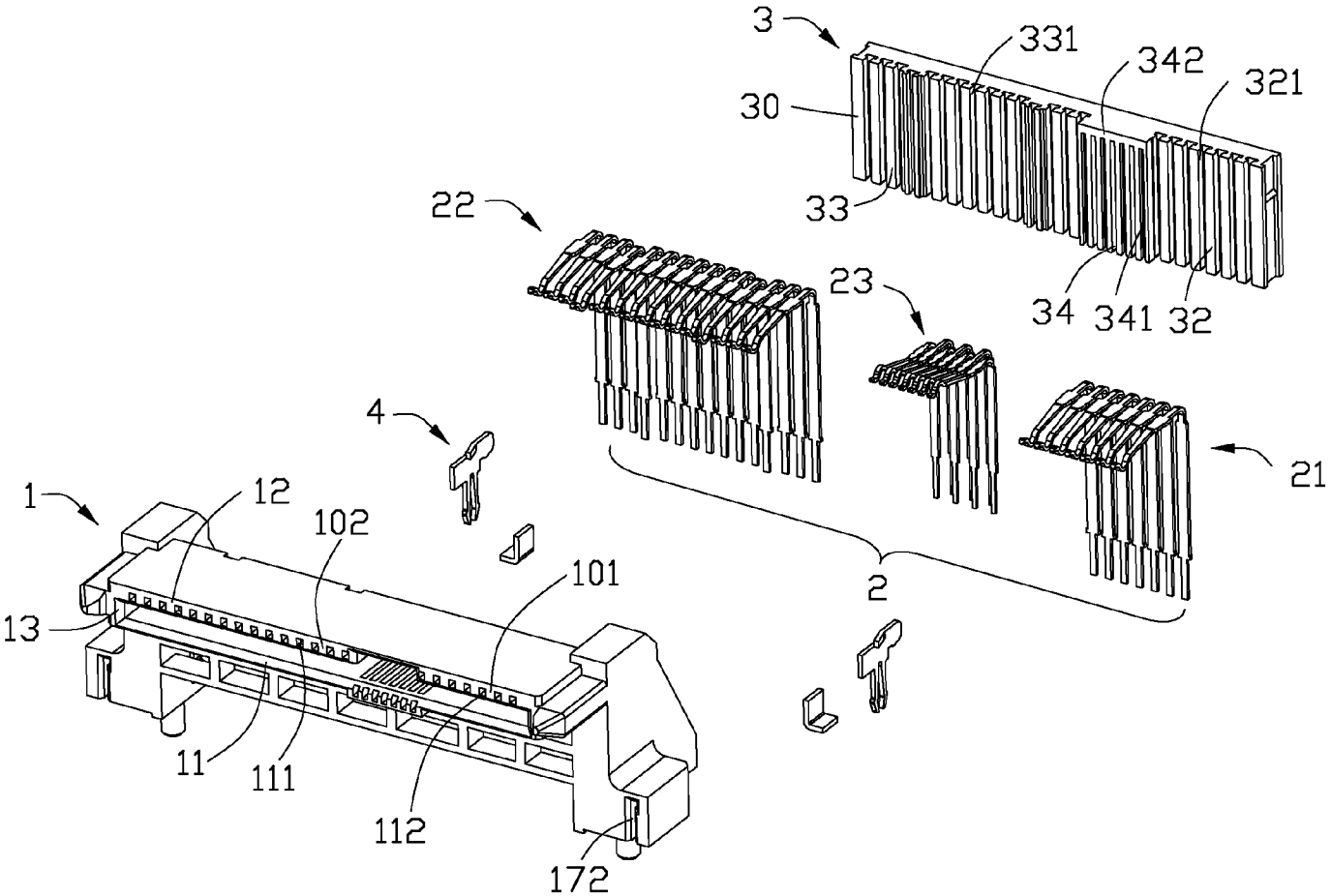
FIG. 1 is an exploded perspective view of an electrical connector in accordance with the present invention.

Further detailed description of the preferred embodiments of this present invention is set forth below along with the attached drawings. Referring to FIGS. 1-8, an electrical connector 100 in accordance with the present invention is mounted in a printed circuit board (PCB) 5 of a computer/server (not shown), and the electrical connector 100 comprises an insulated housing 1, a plurality of terminals 2 received in the insulated housing 1, a metal bar 4 inserted into the insulated housing 1, and a positioning spacer 3 assembled to the insulated housing 1 for positioning the terminals 2.

Figure 2:
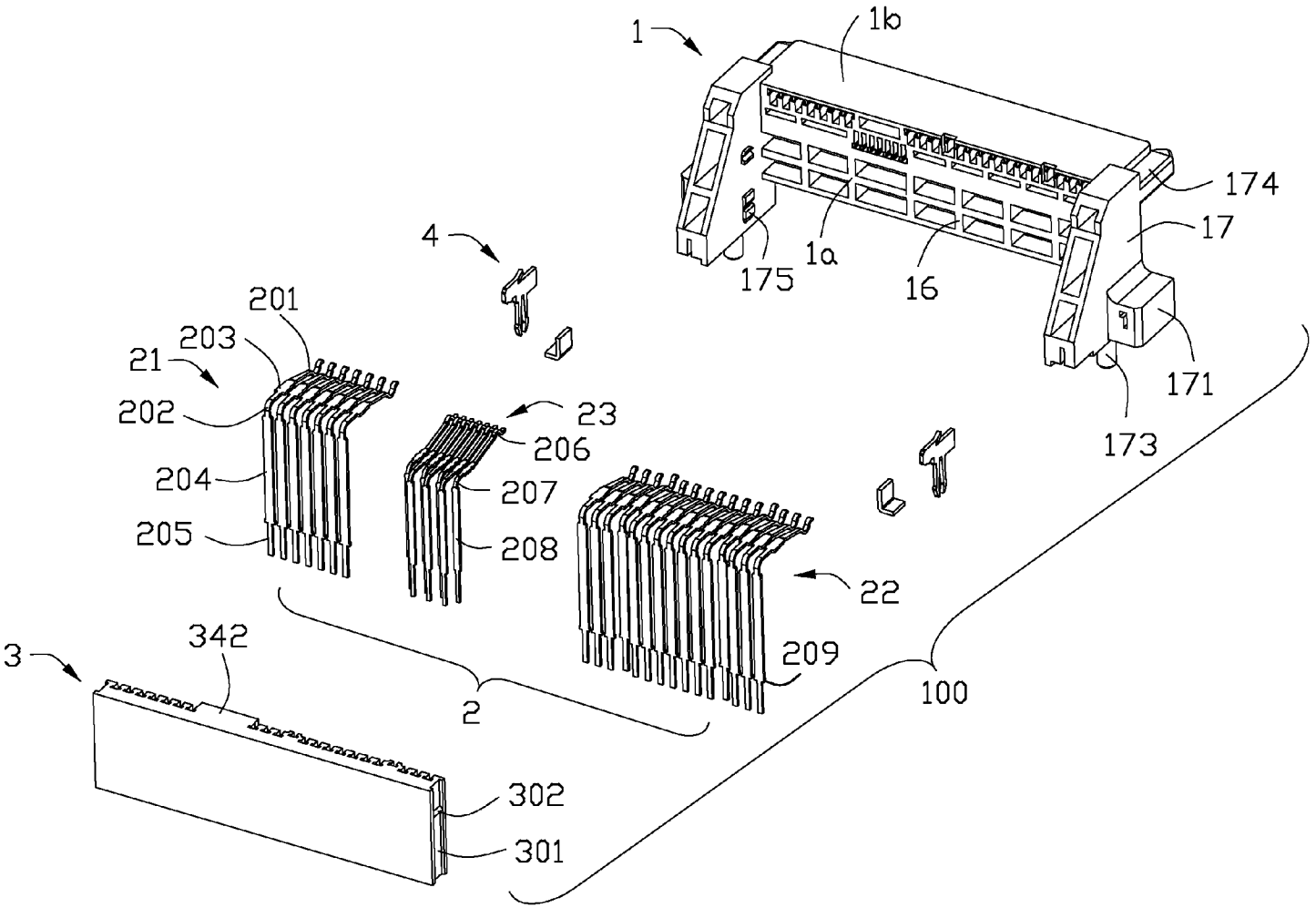
FIG. 2 is an exploded perspective view of the electrical connector from another view.

As showing in FIGS. 1 and 2, the insulated housing 1 comprises an upright base portion 1*a* and a horizontal mating portion 1*b* located on a top surface of the base portion 1*a* and forwardly extending beyond the base portion 1*a*.

Figure 7:
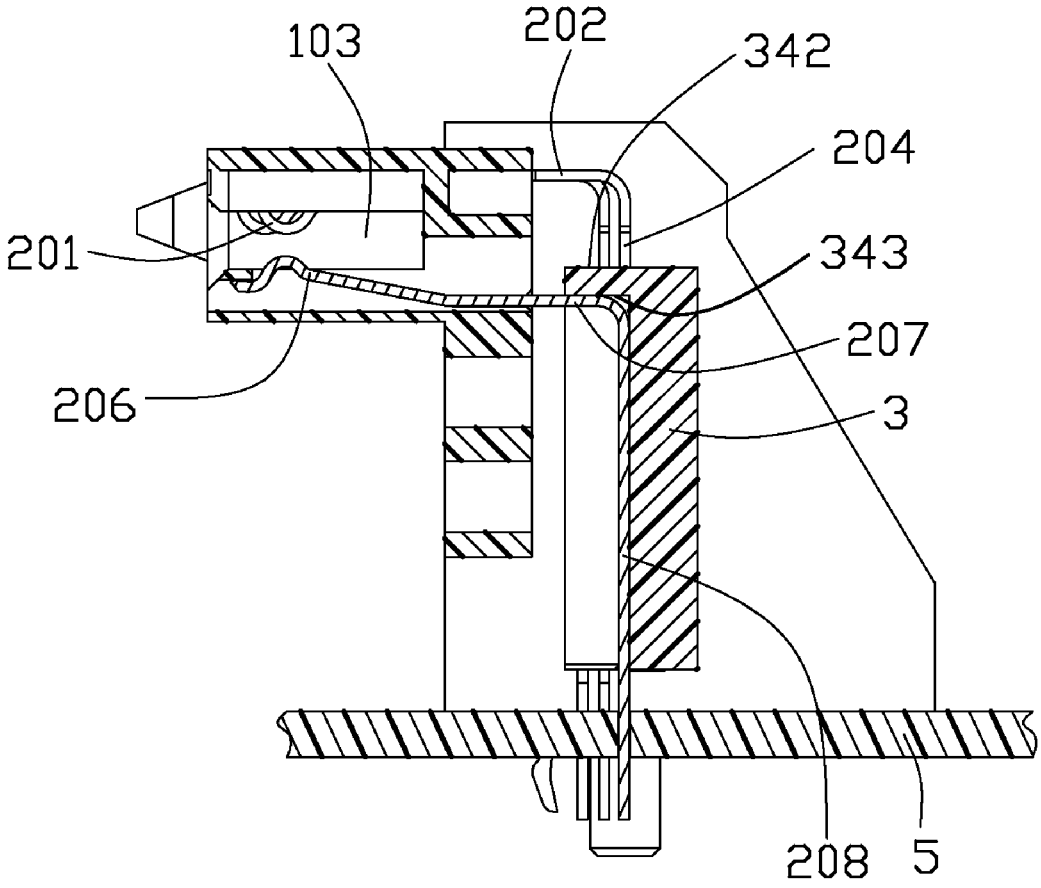
FIG. 7 is a cross-sectional view of the electrical connector taken along line 7-7 of FIG. 6.
Figure 8:
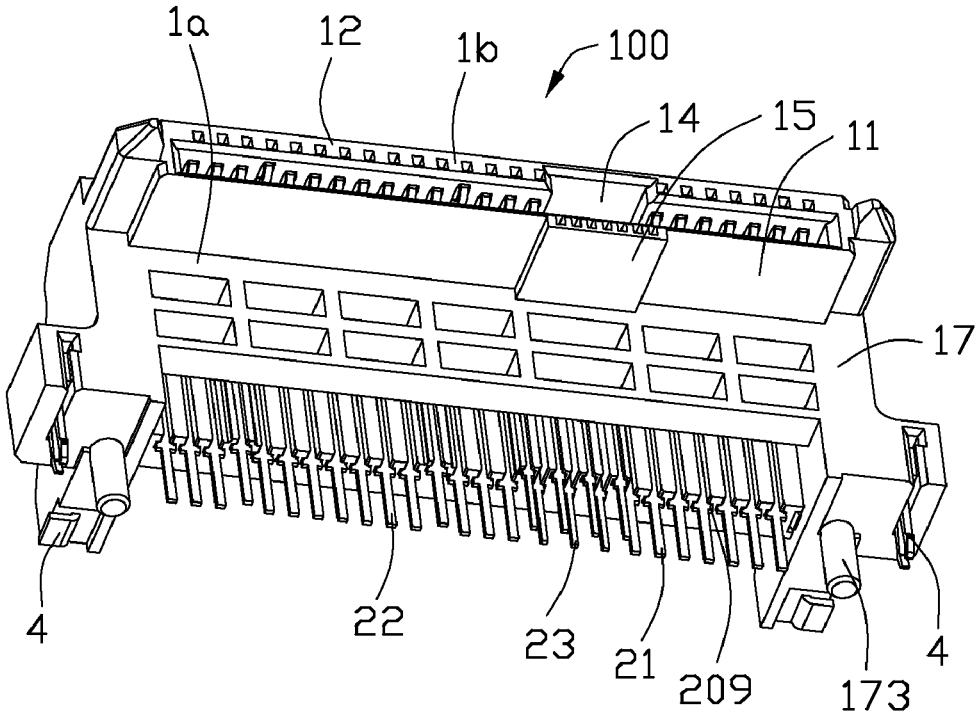
FIG. 8 is a bottom perspective view of the electrical connector showing how the channels are arranged.

The mating portion 1*b* includes a bottom wall 11, an opposing upper wall 12 and a pair of side walls 13 interconnecting with the bottom and the upper walls 11, 12 to define a receiving space 103 labeled in FIG. 7. Combination with FIG. 4, the upper wall 12 has a rectangular-shaped slot 14 which separates the upper wall 12 into a first section 101 and a second section 102 larger than the first section 101. The first section 101 defines seven terminal passages 112 in one row, and the second section 102 also defines fifteen terminal passages 111 in one row. Opposite to the slot 14 of the upper wall 12, the bottom wall 11 correspondingly forms an expansion portion 15 which is thicker than other part thereof. The expansion portion 15 defines seven terminal passages 151.

The base portion 1*a* includes a lengthwise body portion 16 and a pair of supporting portions 17 arranged at left and right ends of the body portion 16. The body portion 16 extends downwardly from a bottom face of the mating portion 1*b*. Each supporting portion 17 forms a retainer portion 171 on a lower end of an outward surface thereof and the retainer portion 171 further has a through slot 172 thereon. The supporting portion 17 further has a positioning post 173 extending downwardly from a bottom surface thereof. A pair of wedge-shaped stoppers 175 is respectively formed on the inner surfaces of the supporting portions 17, and a pair of guiding posts 174 respectively located outside of the side walls 13 and forwardly extends from front surfaces of an upper portion of the supporting portion 17.

Figure 3:
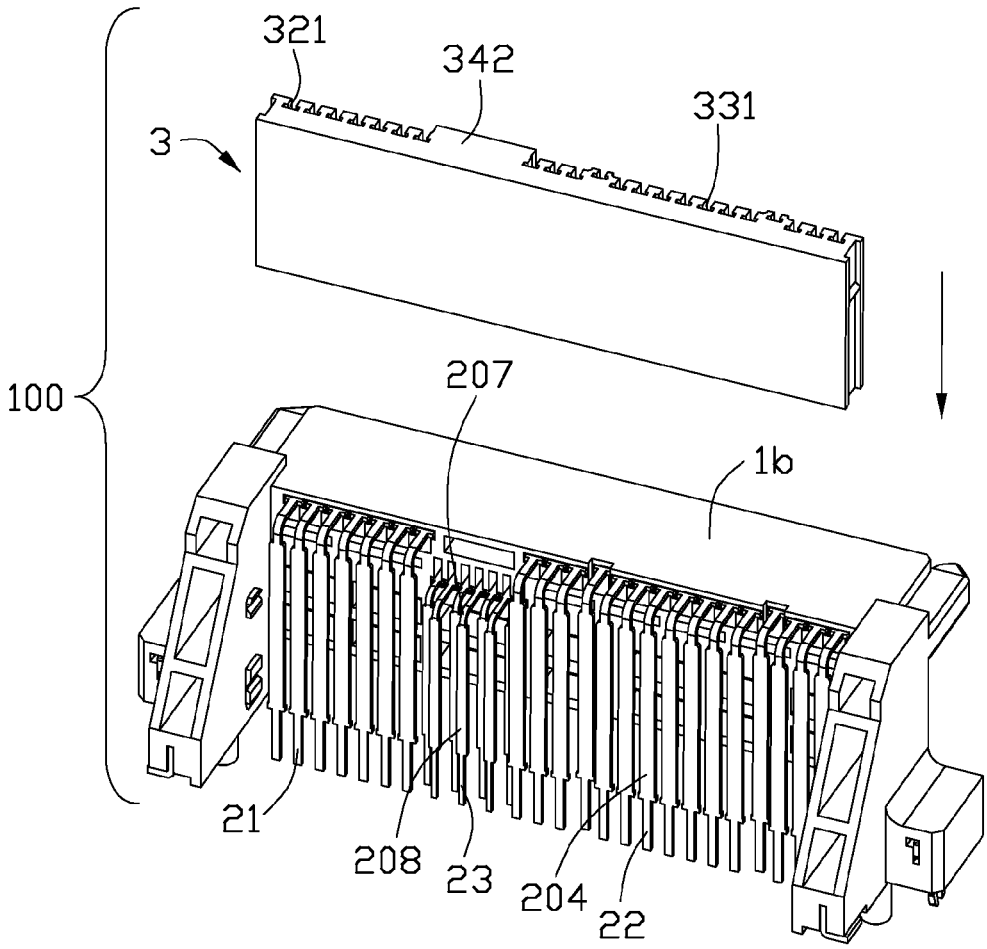
FIG. 3 is a partially exploded perspective view of the electrical connector.
Figure 4:
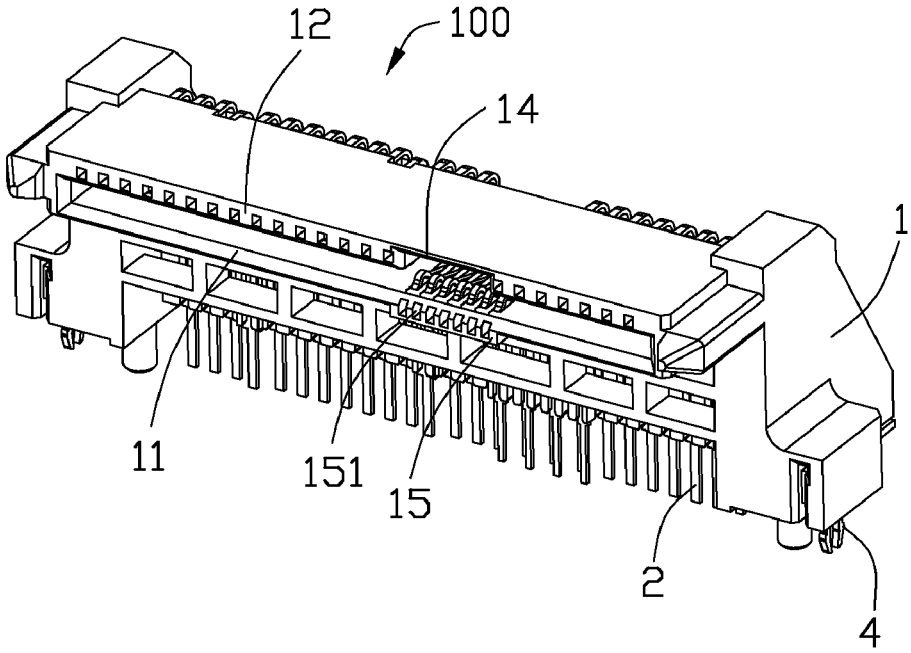
FIG. 4 is a perspective view of the electrical connector.
Figure 5:
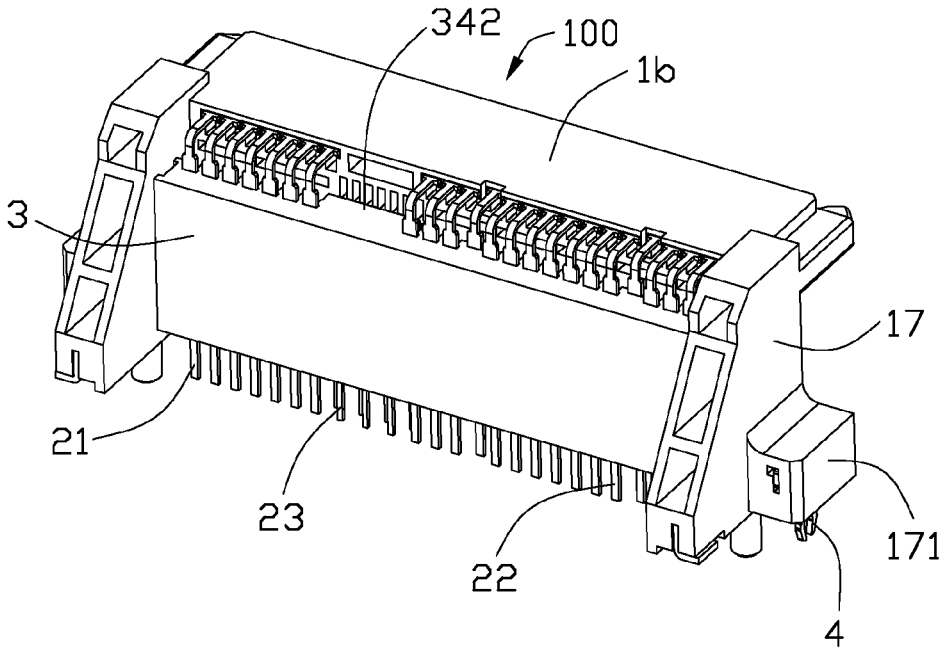
FIG. 5 is a view similar to FIG. 4, but viewed from another aspect.
Figure 6:
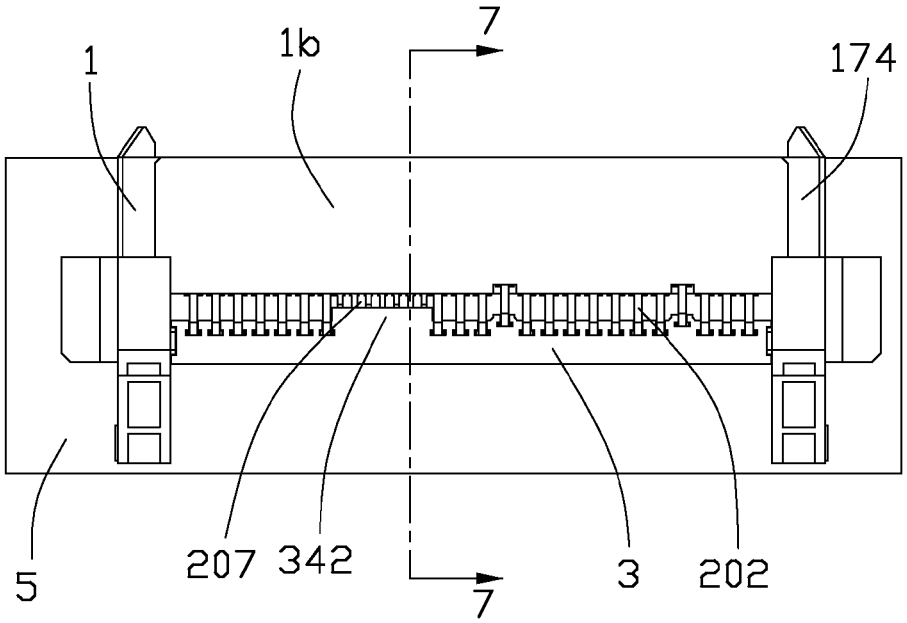
FIG. 6 is a top view of the electrical connector on a print circuit board.

The terminals 2 are separated into three distinct groups, a first group of terminals 21 having seven individual terminals for transmitting data, a second group of terminals 22 including fifteen single terminals for transmitting power and a third group of terminals 23 having seven individual terminals for transmitting data. Each of the first group of terminals 21 and the second group of terminals 22 has identical profile, comprising a curved contacting portion 201 with a deflexed distal end, a slightly slant body portion 202 extending rearward from an end of the contacting portion 201, a vertical leg portion 204 extending downward from an end of the body portion 202 and a slim foot portion 205 extending downward from an end of the leg portion 204. The body portion 202 of each of the first group of terminals 21 and the second group of terminals 22 further forms barbs 203 thereon to increase a retention force between the terminals 2 and the housing 1. A plurality of tubers 209 are defined at the joint of each of the leg portions 204 and the foot portions 205 of the terminals 21, 22. Each of the third group of terminals 23 also has substantially similar configuration as that of the first group of terminals 21 and the second group of terminals 22, except for a contacting portion 206 with an upswept distal end, a shorter body portion 207 and a shorter leg portion 208, compared with corresponding parts of the terminals of the first group of terminals 21 and the second group of terminals 22. That is to say, the contacting portions 206 and the body portions 207 of the third group of terminals 23 are located at a lower place than those of the first group and the second group of terminals 21, 22. Referring to FIG. 3, the parts of the body portions 202, 207 and the leg portions 204, 208 expose to an outside of the housing 1.

Referring to FIGS. 2-3, the positioning spacer 3 defines an inner face 30 facing to a rear face of the body portion 16. The inner face 30 has a first portion 32 and a second portion 33 separated from each other by a cubic portion 34 integrally project to the back face of the housing 1 than the first and second portion 32,33 of the inner face 30. The first portion 32 defines seven vertical channels 321 through a top and a bottom edge of the inner face 30 and aligned with corresponding terminal passages 112 of the mating portion 1*b*, and the second portion 33 also defines fifteen vertical channels 331 through the top and the bottom edge of the inner face 30 and aligned with corresponding terminal passages 111 of the mating portion 1*b*. The cubic portion 34 also defines seven channels 341 running through the bottom edge of the inner face 30 and aligned with corresponding seven terminal passages 151 of the expansion portion 15. The vertical channels 321, 331 of the first and second portion 32, 33 are parallel with each other in a same plane and recessed with a same depth. Please note ribs between a fourth and an eleventh vertical channels of the second portion 33 are a little protruding compared with other vertical channels 321, 331. The vertical channels 341 of the cubic portion 34 are parallel to the vertical channels 321, 331 of the first and second portion 32, 33 but protruding forward. The vertical channels 321, 331 of the first and second portion 32, 33 extends through the spacer 3 from the top face to a bottom face, while the vertical channels 341 of the cubic block 34 extends though the bottom face of the spacer 3 and not run through the top face to form a pressing platform 342 at the top face of the spacer 3. A plurality of pressing faces 343 is provided at inner bottom face of the pressing platform 342 partitioned by the ribs between the channels 341. In addition, two opposite ends of the spacer 3 are respectively defined a cutout 301 with a wedged tab 302 therein.

When assembly, firstly, the terminals 2 are assembled to the insulated housing 1, with the contacting portions 201 and the body portions 202 of the first group of terminals 21 and the second group of terminals 22 respectively inserted into the terminal passages 111, 112 of the upper wall 12, and the contacting portions 206 and the body portions 207 of the third group of terminals 23 inserted into terminal passages 151 of the expansion portion 15 of the bottom wall 11. Secondly, the spacer 3 is assembled to the housing along the leg portion 204, 208 of the terminals 2, then the leg portions 204 of the first group of terminals 21 and the second group of terminals 22 pressed fitly into the vertical channels 321, 331 of the first and second portions 32, 33 of the spacer 3, and the leg portions 208 of the third group of terminals 23 pressed fitly into the vertical channels 341 of the cubic block 34 of spacer 3. At the moment, the tubers 209 of the terminals 21, 22 are engaged with the lower ends of the vertical channels 321, 331, and the body portions 207 are engaged with the pressing face 343 of the pressing platform 342 of the spacer 3. Of course the spacer 3 is sandwiched between the pair of supporting portions 17 and abutting against a back surface of the base portion 1*a*, and the pair of stoppers 175 of the supporting portions 17 engaging with the tabs 302 of the spacer 3 to provide a retaining force.

Thirdly, the metal bar 4 are respectively inserted into the through slots 172 of the retainer portion 171 of the insulated housing 1, then the insulated housing 1 is mounted to the printed circuit board (PCB) 5, with the pair of positioning posts 173 respectively inserted into a pair of first retaining holes (not labeled) of the PCB 5, the foot portions 205 of the terminals 2 inserted in conductive pads (not labeled) of the PCB 5 and soldered therein. In addition, superadd the metal bar 4 engaging with PCB 5, the insulated housing 1 can be securely mounted on the PCB 5.

With this design, the spacer 3 defines the pressing platform 342 having the pressing face 343 pressing against the body portion 207 of the third terminal 23 for protecting the body portion 207 of the third terminal 23 at the vertical direction when the connector 100 mounted to the print circuit board 5.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed. For example, the third terminals are received in the expansion portion which defined at the upper wall, then the pressing platform of the spacer is using for protecting the body portion of the first and second terminals, or the spacer has two pressing platforms protecting the body portions of the first, second and third terminals in another embodiment.

I claim:

1. An electrical connector comprising:

an insulative housing defining a mating portion having a plurality of passageways therein;

a plurality of terminals separated into at least two distinct groups and received in the insulative housing, each of the plurality of terminals defining a contacting portion received in the passageways, a body portion parallel extending rearward from the contacting portion and a leg portion extending downward from the body portion, the body portion and the leg portion exposing to an outside of the insulating housing; and a positioning spacer assembled to a back side of the insulative housing, the position spacer defining a plurality of channels in an inner face thereof to position the leg portions of the terminals and further defining a pressing platform which has a plurality of pressing faces to press against the body portions of at least one group of terminals; the pressing platform is located at a top edge of the positioning spacer, the channels corresponding to the one group of the terminals do not run through the pressing platform thereby forming the plurality of pressing faces.

2. The electrical connector as described in claim 1, wherein the body portions of said one group of the terminals is lower than the body portions of other group of terminals.

3. The electrical connector as described in claim 2, wherein other channels corresponding to other group of the terminal run through the top edge of the positioning spacer.

4. The electrical connector as described in claim 1, wherein mating portion defines a bottom wall, an upper wall and a pair of side walls interconnecting with the bottom wall and the upper wall to a mating space, the passageways are formed in the upper and bottom walls.

5. The electrical connector as described in claim 4, wherein the upper wall has a rectangular-shaped slot which separates the upper wall into a first section and a second section larger than the first section.

6. The electrical connector as described in claim 5, wherein opposite to the slot of the upper wall, the bottom wall forms an expansion portion which is thicker than other part thereof.

7. The electrical connector as described in claim 6, wherein the contacting portions of said one group of the terminals is received in the expansion portion.

8. An electrical connector comprising:

an insulated housing defining a mating portion, said mating portion having a bottom wall and an upper wall and two side walls with thereamong a longitudinal space along a longitudinal direction thereof;

one group of terminals located in the upper wall with the contacting portions exposing to the space;

another group of terminals located in the bottom wall with the contacting portions exposing to the space, each terminal of the another group of terminals further defining a horizontal body portion extending from the contacting portion and exposing an exterior of the insulating housing; and a positioning spacer having an inner face pressing against a back side of the insulative housing to fix the terminals, the inner face of the positioning spacer further defining a pressing platform which has a plurality of inner face pressing against the body portions of said another group of terminals; a pressing platform which has a plurality of inner faces pressing against the body portions of said another group of terminals, the pressing platform being located at a top edge of the positioning spacer.

9. The electrical connector as described in claim 8, wherein the inner face of the positioning spacer defines a plurality of vertical channels corresponding to leg portions of said two groups of terminals.

10. The electrical connector as described in claim 9, wherein said one group of terminals has horizontal body portions which exposing to the exterior of the insulating housing.

11. The electrical connector as described in claim 7, wherein the upper wall has a rectangular-shaped slot which separates the upper wall into a first section and a second section larger than the first section.

12. The electrical connector as described in claim 11, wherein opposite to the slot of the upper wall, the bottom wall forms an expansion portion which is thicker than other part thereof.

13. The electrical connector as described in claim 12, wherein the contacting portions of said another group of terminals is received in the expansion portion.

14. An electrical connector comprising:

an insulative housing defining a plurality of passageways extending along a front-to-back direction;

a plurality of contacts disposed in the corresponding passageways, respectively, each of said contacts defining a front contacting section essentially extending in the front-to-back direction, and a rear tail section essentially extending downwardly on a rear side of the housing;

said contacts including a group defining a fine pitch, the tail section of each of said group of the contacts forming an expanded region around a middle portion in a vertical direction perpendicular to said front-to-back direction, and arranged in two rows; and an insulative spacer downwardly assembled to the rear side of the housing in said vertical direction and defining a set of side by side arranged channels staggered with one another in two rows corresponding to the tail sections of the group of the contacts; wherein each of said channels defines in top view a T-shaped cross-sectional configuration including a large section receiving the expanded region and a small section receiving a corresponding body portion linked between the tail section and the contacting section, whereby the corresponding tail section is retained in position in said front-to-back direction.

15. The electrical connector as claimed in claim 14, wherein said spacer is equipped with a pressing platform on a top portion to downwardly press the body portions of the corresponding contacts so as to prevent upward movement of the tail sections of the corresponding contacts.

16. The electrical connector as claimed in claim 14, wherein a transverse dimension of the expanded region is essentially close to the pitch.

17. The electrical connector as claimed in claimed in claim 14, wherein said contacts includes another group defining another pitch larger than the pitch, and the tail sections of said another group of the contacts defining another expanded sections while arranged in essentially one row.

18. The electrical connector as claimed in claim 17, wherein said spacer defines another set of channels arranged in essentially one row to receive the tail sections of the corresponding another group of the contacts.

19. The electrical connector as claimed in claim 18, wherein the tail sections of said another group of the contacts extend upward beyond the spacer, and said spacer provides no downward pressing against the tail sections of said another group of the contacts.

* * * * *